US008994765B2

(12) United States Patent
Iguchi

(10) Patent No.: US 8,994,765 B2
(45) Date of Patent: Mar. 31, 2015

(54) DECOLORING SYSTEM AND CONTROL METHOD OF DECOLORING SYSTEM

(71) Applicant: Toshiba Tec Kabushiki Kaisha, Tokyo (JP)

(72) Inventor: Ken Iguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 84 days.

(21) Appl. No.: 13/791,687

(22) Filed: Mar. 8, 2013

(65) Prior Publication Data

US 2013/0258026 A1 Oct. 3, 2013

Related U.S. Application Data

(60) Provisional application No. 61/612,214, filed on Mar. 16, 2012.

(51) Int. Cl.
*B41J 29/16* (2006.01)
*B41M 7/00* (2006.01)

(52) U.S. Cl.
CPC ..... *B41M 7/0009* (2013.01)
USPC ..... 347/179

(58) Field of Classification Search
USPC ..... 347/179, 171, 222
See application file for complete search history.

(56) References Cited

U.S. PATENT DOCUMENTS

| | | | |
|---|---|---|---|
| 5,257,064 | A | 10/1993 | Okamoto |
| 6,071,352 | A | 6/2000 | Sugie et al. |
| 2011/0222130 | A1 | 9/2011 | Iguchi |
| 2012/0149562 | A1 | 6/2012 | Iguchi |
| 2012/0306982 | A1 | 12/2012 | Taki |
| 2012/0306985 | A1 | 12/2012 | Iguchi |
| 2013/0002783 | A1 | 1/2013 | Mizutani |
| 2013/0002784 | A1 | 1/2013 | Iguchi |

FOREIGN PATENT DOCUMENTS

| | | |
|---|---|---|
| JP | 09-146417 | 6/1997 |
| JP | 09-244488 | 9/1997 |

*Primary Examiner* — Kristal Feggins
(74) *Attorney, Agent, or Firm* — Patterson & Sheridan LLP

(57) ABSTRACT

A decoloring system has a scanner that reads an image on a paper sheet and generates image data; a first roller that applies heat on the paper sheet to decolor the image on the paper sheet; a heater that heats the roller; a first transporting mechanism that transports the paper sheet to the scanner; a second transporting mechanism that transports the paper sheet via the first transporting mechanism to the heater; and a controller that determines the operating condition of the heater and the transporting speed of the paper sheet on the basis of a specific code or a printing set-up printed on the paper sheet.

16 Claims, 15 Drawing Sheets

*Fig. 5*

110

| First Resolution (dpi) | Second Resolution (dpi) | First reading velocity V1(mm/sec) | Erasing velocity VE(mm/sec) | Second reading velocity V2(mm/sec) |
|---|---|---|---|---|
| Non | 150/200 | 500 | 220 | 230 |
| 100 | 150/200 | 300 | 160 | 230 |
| 150 | 150/200 | 230 | 140 | 230 |
| 200 | 150/200 | 230 | 140 | 230 |
| 300 | 150/200 | 150 | 110 | 230 |

*Fig. 6*

111

| First Resolution (dpi) | First heater | Second heater | Third heater | Heat roller 60 temperature T1 (°C) | Heat roller 62 Temperature T2 (°C) |
|---|---|---|---|---|---|
| Non | ON | ON | ON | 175 | 160 |
| 100 | ON | ON | OFF | 165 | 150 |
| 150 | ON | ON | OFF | 160 | 145 |
| 200 | ON | ON | OFF | 160 | 145 |
| 300 | ON | ON | OFF | 155 | 140 |

*Fig. 7*

112

| First Resolution (dpi) | First heater | Second heater | Third heater | Heat roller 60 temperature T1 (°C) | Heat roller 62 Temperature T2 (°C) |
|---|---|---|---|---|---|
| Non | ON | ON | OFF | 175 | 70 |
| 100 | ON | ON | OFF | 165 | 70 |
| 150 | ON | OFF | OFF | 160 | - |
| 200 | ON | OFF | OFF | 160 | - |
| 300 | ON | OFF | OFF | 155 | - |

*Fig. 8*

113

| DOCUMENT ID | DOUBLE-SIDED/ SINGLE-SIDED | N in 1 | Color | User ID |
|---|---|---|---|---|
| 20120201_00001 | SINGLE-SIDED | 1 in 1 | BLACK AND WHITE | TEC00001 |
| 20120201_00002 | DOUBLE-SIDED | 2 in 1 | FULL-COLOR | TEC00002 |
| 20120201_00003 | DOUBLE-SIDED | 2 in 1 | FULL-COLOR | TEC00001 |
| | | | | |

DECOLORING SYSTEM AND CONTROL METHOD OF DECOLORING SYSTEM

CROSS-REFERENCE TO RELATED APPLICATION

This application is based upon and claims the benefit of priority of U.S. Provisional Patent Application No. 61/612,214, filed on Mar. 16, 2012; the entire contents of which are incorporated herein by reference.

FIELD

Embodiments described herein relate generally to a decoloring system for erasing the color of the image formed on a paper sheet and the control method of the decoloring system.

BACKGROUND

People have developed a recording material that can have its color erased when heated over a prescribed temperature. When this recording material is adopted, by applying heat on the image printed on the paper sheet, the paper sheet can be reused. However, in order to reuse the paper sheet, it is necessary to check whether the color of the image is sufficiently erased over a certain level of soundness and whether the paper sheet is not broken. In the recent years, people have developed a decoloring system with the function in decoloring the color on the paper sheet and the function in determining whether the paper sheet can be reused.

DESCRIPTION OF THE DRAWINGS

FIG. 5 is a reference table illustrating the relationship between the resolution and the paper sheet transporting speed in the first embodiment.

FIG. 6 is a reference table illustrating the relationship between the resolution and the controlled temperature of the heating roller when the decoloring process is carried out for both sides of the paper sheet in the first embodiment.

FIG. 7 is a reference table illustrating the relationship between the resolution and the controlled temperature of the heating roller when the decoloring process is carried out for one side of the paper sheet in the first embodiment.

FIG. 8 is a diagram illustrating the configuration of the table wherein the printing setting is recorded in the first embodiment.

DETAILED DESCRIPTION

Figure 1:
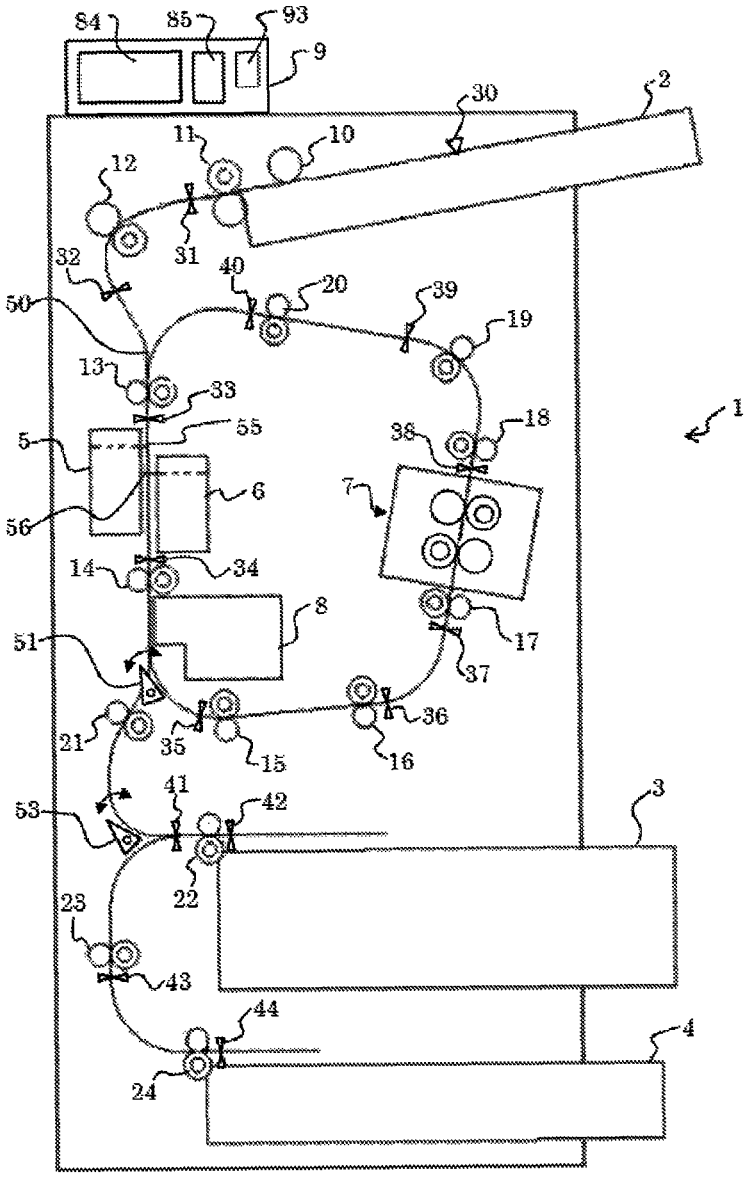
FIG. 1 is a diagram illustrating the configuration of the decoloring system in a first embodiment.

In general, the embodiment according to the disclosure will be described with reference to the drawings. In the drawings, the same reference numerals denote the same or similar portions respectively.

In the following, the first embodiment will be explained with reference to FIG. 1 to FIG. 16. FIG. 1 is a diagram illustrating the configuration of a decoloring system 1 of the first embodiment. Here, the decoloring system 1 uses a decolorable toner or decolorable ink or another "decolorable coloring material" to carry out "decoloring process" for the paper sheet (recording media) having an image formed on its surface. Here, the decoloring process is defined as the process for erasing the color of the image with the decolorable coloring material. The decolorable coloring material refers to the coloring agent, the developing agent, or the decoloring agent. An example of the coloring agent is leuco dye. An example of the developing agent is one or more phenol. The decoloring agent is a substance that has a mutual dissolving ability with the developing agent and has no affinity to the coloring agent when heated. The decolorable coloring material is colored due to the interaction between the coloring agent and the developing agent. When heated over the decoloring temperature, the interaction between the coloring agent and the developing agent stops, so that decoloration takes place. In the following, the decolorable coloring material will be referred as the recording material.

The decoloring system 1 has a paper feeding tray 2, paper exhausting trays 3 and 4, scanners 5 and 6, a decoloring unit 7, a printer 8, a paper transporting mechanism, and an operation panel 9. The paper transporting mechanism contains plural rollers, sensors and transporting passages. The transporting passages are defined below. The transporting passage from the roller 11 to a merging point 50 is defined as the first transporting passage; the transporting passage from the merging point 50 to a gate 51 is defined as the second transporting passage; the transporting passage from the gate 51 via the decoloring unit 7 to the merging point 50 is defined as the third transporting passage; the transporting passage from the gate 51 via a gate 53 to the paper exhausting tray 3 is defined as the fourth transporting passage; and the transporting passage from the gate 53 to the paper exhausting tray 4 is defined as the fifth transporting passage.

According to the first embodiment, the rollers commonly include a pair of rollers. Although not a necessity, one roller is the driving roller connected to the motor either directly or indirectly, while the other roller is a slave roller that is rotated following the driving roller. In the figure, the driving roller is indicated by a circle in a circle.

The paper feeding tray 2 accommodates the paper sheets subject to processing for reuse. Here, the process for reuse is defined as a series of processes including the following functions: the function of acquisition of the image data from the paper sheet before the decoloring process, the function of the decoloring process, and the function of the checkup of the decoloration and the state level of the paper sheet. The paper feeding tray 2 has a sensor 30, a pickup roller 10, and a roller unit 11. The sensor 30 detects the presence/absence of the paper sheet in the paper feeding tray 2. The pickup roller 10 transports the paper sheet to the roller unit 11. The upper roller of the roller unit 11 is rotated in the direction for transporting the paper sheet towards the interior of the system, and the lower roller of the roller unit 11 is rotated in the direction opposite to that of the upper roller. Consequently, the roller unit 11 can transport the paper sheets one at a time.

In the first transporting passage, a paper sensor 31, a roller 12 and a paper sensor 32 are arranged in order from the upstream side in the paper transporting direction. The paper sensor detects whether there is a paper sheet at the detecting position of the sensor. The paper sensor is not limited to the optical sensor. It may also be a mechanical sensor, a sonic wave-type sensor, etc.

In the second transporting passage, a roller 13, a paper sensor 33, scanners 5 and 6, a paper sensor 34, a roller 14, a printer 8, and a gate 51 are arranged in order from the upstream side in the paper transporting direction. Here, the scanners 5 and 6 each have an image sensor. The image sensor is, but is not limited to, a one-dimensional CCD line sensor. It may also be a two-dimensional CCD sensor. The image sensor receives the light emitted from a light source not shown in the figure and reflected from the surface of the paper sheet. The image sensor converts the image, wrinkles, holes, damages, etc. on the paper sheet to the image data. The scanner 5 is arranged on the side of the sheet opposite to the scanner 6, with the second transporting passage sandwiched between them. The scanner 5 generates the image data from one side of the paper sheet at a reading position 55. The scanner 6 generates the image data from the other side of the paper sheet at the reading position 56. The decoloring system 1 can generate the image data from both sides of each paper sheet in a single round of the operation.

The printer 8 has the function of printing on one side of the paper sheet being transported. This printer 8 is, but is not limited to, an inkjet-type printer. It may also be an electrophotographic-type, a thermal-type or the like. The ink is made of the recording material. The gate 51 can switch the transporting direction of the paper sheet to either the third transporting passage or the fourth transporting passage.

In the third transporting passage, a paper sensor 35, a roller 15, a roller 16, paper sensors 36 and 37, a roller 17, a decoloring unit 7, a paper sensor 38, rollers 18 and 19, a paper sensor 39, a roller 20, and a paper sensor 40 are arranged in order.

In the fourth transporting passage, a roller 21, a gate 53, a paper sensor 41, a roller 22, and a paper sensor 42 are arranged in order from the upstream side in the paper transporting direction. In the fifth transporting passage, a roller 23, a paper sensor 43, a roller 24, and a paper sensor 44 are arranged in order from the upstream side in the paper transporting direction.

The paper exhausting trays 3 and 4 accommodate the paper sheets separated after the end of the decoloring process. For example, the paper sheets that can be reused are accommodated in the paper exhausting tray 3, while the paper sheets that cannot be reused are accommodated in the paper exhausting tray 4.

The operation panel 9 has a touch panel display 84, a tag reader 85, and a camera 93. Here, the touch panel display 84 displays the graphical user interface (GUI), and it receives a user's instruction from the buttons, keyboard, etc. arranged in the GUI. The tag reader 85 reads the information from a non-contact IC tag. The user information can be read from an IC card held by a user. The tag reader 85 may contain a system for reading the magnetic stripe card. The camera 93 has a two-dimensional CCD image sensor, and it can recognize the one-dimensional or two-dimensional barcode or the like.

Figure 2:
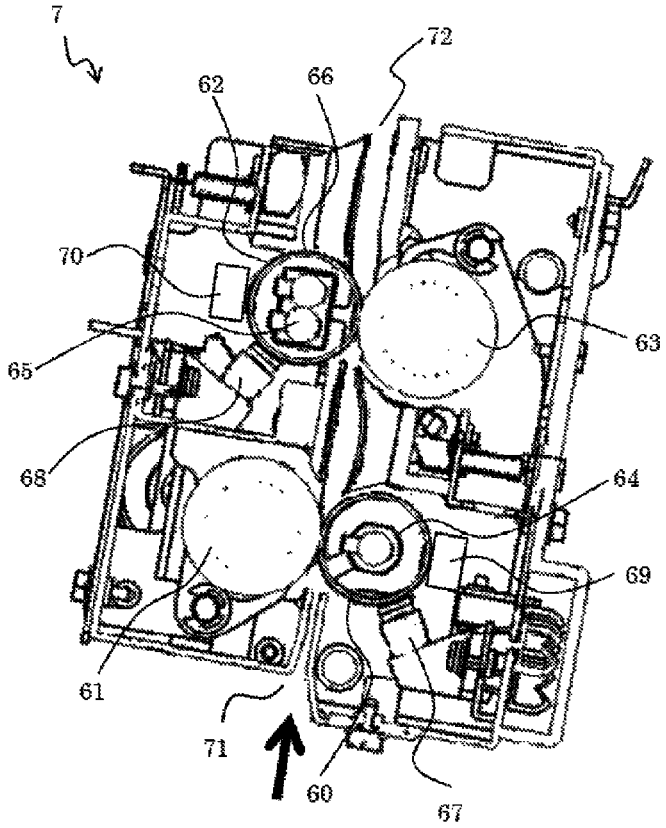
FIG. 2 is a diagram illustrating the configuration of the decoloring unit in the first embodiment.

FIG. 2 is a diagram illustrating the configuration of the decoloring unit. Here, the decoloring unit 7 has heating rollers 60 and 62, pressing rollers 61 and 63, a first heater 64, a second heater 65, a third heater 66, temperature sensors 67 and 68, and thermostats 69 and 70. The paper sheet enters through an inlet 71 into the decoloring unit 7, and it is exhausted through an outlet 72. The arrow indicates the transporting direction of the paper sheet.

The heating rollers 60 and 62 are made of metal tubes. The heating roller 60 contains the first heater 64 inside of it. The heating roller 62 contains the second heater 65 and the third heater 66 inside of it. The first heater 64 is a halogen lamp heater with a nominal output power of 600 W. The second heater 65 and the third heater 66 each are halogen lamp heaters with a nominal output power of 300 W. The heaters are not limited to the halogen lamp heaters. They may also be ceramic heaters or inductive heaters.

The pressing rollers are made of silicone rubber. The pressing roller 61 is arranged at the position in contact with the heating roller 60. The pressing roller 63 is arranged at the position in contact with the heating roller 62. As the heating roller and the pressing roller are rotated, the paper sheet is transported through the pinch region there between. The heating roller 62 is arranged on the downstream side in the paper transporting direction in comparison with the heating roller 60. The heating roller 60 heats up one side of the paper sheet, and the heating roller 62 heats up the other side of the paper sheet. That is, the heating roller 60 is arranged on the side opposite to the heating roller 62 with respect to the third transporting passage.

Abutting the surface of the heating roller 64, the temperature sensor 67 and the thermostat 69 are arranged. Abutting the surface of the heating roller 66, the temperature sensor 69 and the thermostat 70 are arranged. The temperature sensors 67 and 68 detect the surface temperature of the heating rollers, respectively. The thermostats 69 and 70 cut off the power supply to any of the heaters 64 to 66 when the heating roller is heated over a prescribed temperature level.

Figure 3:
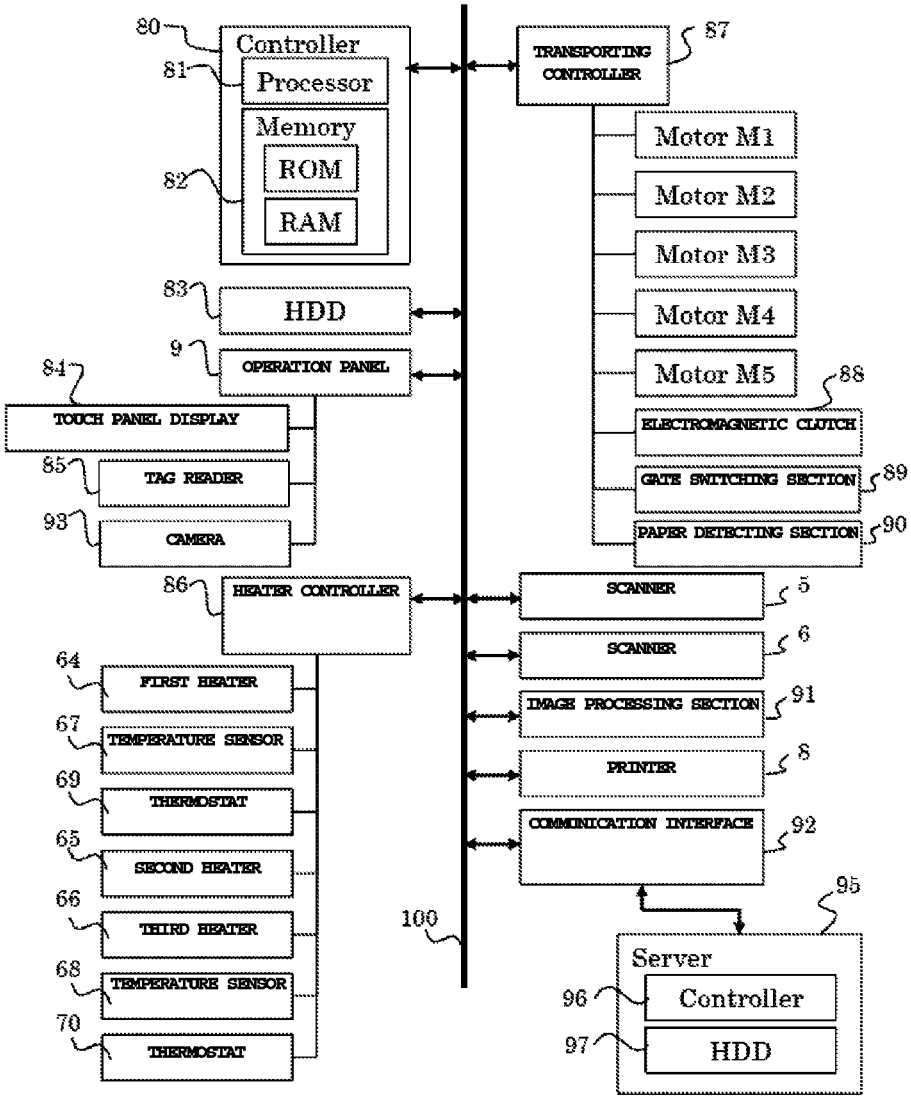
FIG. 3 is a block diagram illustrating the function of the decoloring system in the first embodiment.

FIG. 3 is a block diagram illustrating the function of the decoloring system. Here, a controller 80 of the decoloring system 1 has a CPU (central processing unit) or another processor 81 and a memory 82. The memory 82 contains ROM (read-only memory) and RAM (random access memory), etc. Here, the ROM is for storing the programs for controlling the controller 80. The RAM is for temporarily storing the programs and data files that can be used by the processor 81. The controller 80 is connected via a bus 100 to an HDD (hard disk drive) 83, the operation panel 9, a heater controller 86, a transporting controller 87, a scanner 5, a scanner 6, an image processing section 91, a printer 8, and a communication interface 92, and it can carry out mutual communication with these devices.

The HDD 83 stores the image data generated by the scanner 5 and the scanner 6. One may also adopt a flash memory or another nonvolatile memory in place of the HDD. The operation panel 9 has a touch panel display 84, a tag reader 85, and the camera 93. The controller of the operation panel 9 controls the various devices according to the instructions from the controller 80.

The heater controller 86 is connected to a first heater 64, a second heater 65, a third heater 66, the temperature sensors 67 and 68, and the thermostats 69 and 70. Corresponding to the instructions from the controller 80 and the outputs of the various temperature sensors, the heater controller 86 controls the first heater 64, the second heater 65, and the third heater 66.

The transporting controller 87 controls the motors M1 to M5, the electromagnetic clutch 88, the gate switching section 89, and the paper feeding detecting section 90. The motors M1 to M5 provide driving forces to the plural rollers. The electromagnetic clutch 88 controls the transmission of the driving force from the motor to the roller. The gate switching section 89 switches the stop positions of the gates 51 and 53. The paper feeding detecting section 90 receives the output from the paper sensors 30 to 44 and detects the position of the paper sheet in the decoloring system 1.

The image processing section 91 converts the image data generated by the scanner 5 and the scanner 6 to the image file in JPEG (Joint Photographic Expert Group) format, one of the formats of the image file, and stores them in the HDD 83. The image processing section 91 checks the state of the paper sheet from the image data and determines whether the paper sheet can be reused. The image processing section 91 is an ASIC (Application Specific Integrated Circuit). However, this is not exclusive. The programs for the execution in the controller 80 are contained.

The communication interface 92 is connected to the decoloring system 1 and the server 95 via LAN (Local Area Network), WAN (Wide Area Network), or the like. The server 95 contains a controller 96 and an HDD 97. The server 95 receives the image data stored in the HDD 83 and has them stored in the HDD 97. Also, the server 95 receives from the decoloring system 1 the read ID from the tag reader 85 and the camera 93; on the basis of the received read ID, it sends the data to the decoloring system 1.

Figure 4:
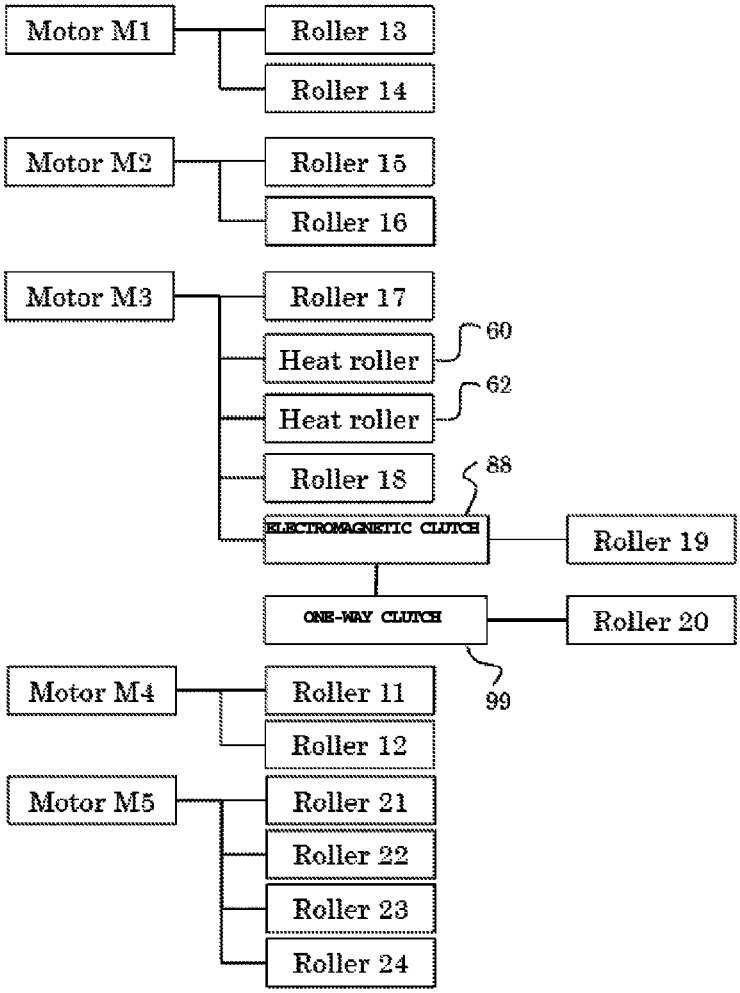
FIG. 4 is a diagram illustrating the configuration of the interconnection between the motors and the rollers in the first embodiment.

FIG. 4 is a diagram illustrating the configuration of the interconnection between the motors and the rollers. In FIG. 4, the plural gears connecting the motors to rollers are not shown. The motor M1 is connected to the rollers 13 and 14. The motor M2 is connected to the rollers 15 and 16. The motor M3 is connected to the roller 17, the heating rollers 60 and 62, the roller 18, and the electromagnetic clutch 88. The electromagnetic clutch 88 is connected to the roller 19 and the one-way clutch 99. The one-way clutch 99 is connected to the roller 20. When the motor M3 is driven to rotate, the transporting controller 87 controls the electromagnetic clutch 88, so that the rollers 19 and 20 can be stopped. The one-way clutch 99 rotates idling when the rotation speed of the roller 20 is over a prescribed level. The motor M4 is connected to the rollers 11 and 12. The motor M5 is connected to the rollers 21 to 24.

FIG. 5 is a reference table illustrating the relationship between the resolution and the paper sheet transporting speed. For each value of the first resolution, the speed reference table 110 defines the second resolution, the first read speed, the erasing speed, and the second read speed. The first resolution is the resolution setting for the scanners 5 and 6 for storing the image data on the paper sheet. The user may use the operation panel 9 to select the first resolution. "NON" indicates that the storage of the image has not been carried out.

The second resolution is the resolution setting for the scanners 5 and 6 for acquiring the image data of the paper sheet subject to the decoloring process. The second resolution is a resolution for determining whether the paper sheet can be reused. According to the first embodiment, it is possible to select from 2 resolutions, that is, 150 dpi and 200 dpi. Corresponding to the precision of the determination regarding whether the paper sheet can be reused by the image processing section 91, the second resolution is set.

The first read speed V1 is the speed set for the sheet moved by the rollers associated with the motors M1 and M3 when the image data of the paper sheet are generated at the first resolution by the scanners 5 and 6. The erasing speed VE is the speed setting for the sheet driven by the rollers associated with the motor M3 when the paper sheet is transported in the third transporting passage containing the decoloring unit 7. The second read speed V2 is the speed setting for the sheet driven by the rollers associated with the motor M1 when the image data of the paper sheet are generated at the second resolution by the scanners 5 and 6. As the first resolution is set to a higher value, the first read speed V1 and the erasing speed VE are set lower. The erasing speed VE is set to be lower than the first read speed V1 at all of the values of the first resolution. At all of the values of the first resolution, the second read speed is set at a prescribed speed matching the second resolution.

FIG. 6 is a reference or look up table illustrating the relationship between the resolution and the control temperature of the heating roller when the decoloring process is carried out for both sides of the paper sheet. A temperature reference table 111 is taken as reference by the controller 80 and the heater controller 86 when there is an instruction for the execution of the decoloring process on both sides of the paper sheet. For each value of the first resolution, the temperature reference table 111 settings the ON/OFF information of the first, the second and the third heaters, the control temperature T1 of the heating roller 60, and the control temperature T2 of the heating roller 62. At all of the values of the first resolution, the control temperature T1 of the heating roller 60 is set higher than the control temperature T2 of the heating roller 62. As the first resolution is set higher, the control temperatures T1 and T2 are set lower. This is for setting a lower erasing speed VE to match the first resolution. When the control temperatures T1 and T2 are high and the erasing speed VE is low, a heat quantity more than what is required by the paper sheet is applied. As this heat warms the scanners 5 and 6, the scanners 5 and 6 become unstable under the heat influence. According to this application example, the control temperature and the paper sheet transporting speed are selected to ensure that the decoloring process is carried out reliably without influence on the operation of the scanners 5 and 6.

The ON/OFF information of the heater is the information for setting the corresponding heater on/off when the decoloring process is carried out. The heater controller 86 determines whether the power is supplied to the first, the second and the third heaters in the decoloring process.

FIG. 7 is a table illustrating the relationship between the resolution and the control temperature of the heating roller when the decoloring process is carried out for one side of the paper sheet. A temperature reference table 112 is used as a reference by the controller 80 and the heater controller 86 when the user instructs the execution of the decoloring process for one side of the paper sheet. For each value of the first resolution, the temperature reference table 112 sets the ON/OFF threshold of the first, second and third heaters, the control temperature T1 of the heating roller 60, and the control temperature T2 of the heating roller 62. When the first resolution is 150, 200, and 300 dpi, the second and third heaters are not turned on; as a result, the control temperature T2 is not set.

FIG. 8 is a diagram illustrating the configuration of the table for recording the setting up of printing. The storage area of the printing set up table 113 contains HDD 96 of the server 95. However, this is not limited to this. One may also adopt a scheme in which it is stored in the HDD 83 of the decoloring apparatus 1 or the device connected to another network. The field name of the printing set up table 113 contains, but is not limited to, the document ID, the double-sided/single-sided setting up, the N-in-1 setting up, and the user ID. It also contains the standard setting up of printing for the printer, such as the size of the paper sheet, etc., the page number of 1 job, the number of the copies for printing, etc.

The document ID is the ID (Identification) data given to each job printed by the printer. Each job is specified by this document ID. The double-sided/single-sided set up is the set up information pertaining to whether both sides of the paper sheet are in use when printing is carried out by the printer. N-in-1 indicates the number of the originals printed on one side of 1 page. The color indicates printing in monochromic, single color or full color. The user ID indicates the sender of the printed data.

The document ID is printed at the corner of the paper sheet when a sheet is printed by the printer. The printed document ID is, but is not limited to, characters. It may also be a one-dimensional or two-dimensional barcode. When a two-dimensional barcode is printed, the printing set up data related to the document ID are contained in the two-dimensional barcode.

Figure 9A:
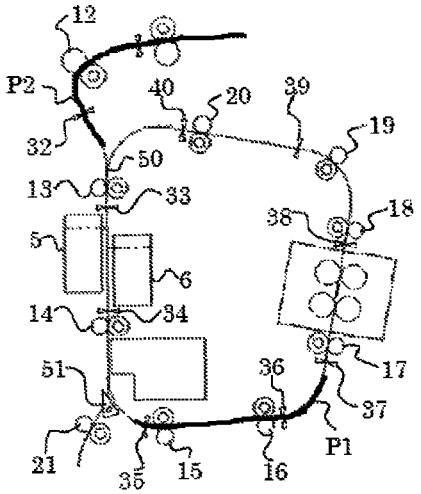
FIGS. 9A to 9D are diagrams illustrating the time series of transporting of the paper sheet in the first embodiment.

FIGS. 9A to 9D show diagrams illustrating the transportation of the paper sheet shown in time sequence. As shown in FIG. 9A, the paper sheet P1 passes through the first transporting passage and the second transporting passage, and it is guided by the gate 51 to the third transporting passage. The motors M1 and M2 drive the rollers to transport a sheet at the first read speed V1. The motor M3 drives the rollers to transport a sheet at the erasing speed VE. As the paper sheet P1 is transported, the scanners 5 and 6 acquire the images on the two sides of the paper sheet P1 at the first resolution. As the front end of the paper sheet P1 is detected by the sensor 37, the motor M2 drives the rollers to transport a sheet at the erasing speed VE. The rollers 15 and 16 transport the paper sheet P1 to the decoloring unit 7. The paper sheet P2 stands by before the merging point 50. At the time when the trailing end of the paper sheet P1 passes the paper sensor 34, the paper sheet P2 is transported from the first transporting passage to the second transporting passage.

Figure 9B:
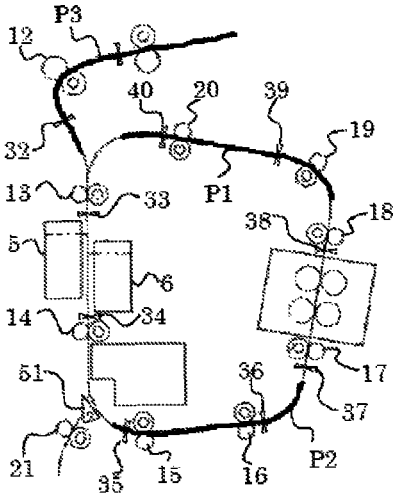

As shown in FIG. 9B, the paper sheet P1 passes the decoloring unit 7, and it is transported in the third transporting passage at the erasing speed VE until the front end is detected by the paper sensor 40. After the image data is read by the scanners 6 and 7 and until the front end of the paper sheet P2 is detected by the sensor 37, the paper sheet P2 is transported at the first read speed V1. At the time when the front end of the paper sheet P1 is detected by the paper sensor 40, the transporting controller 87 checks whether the paper sheet P2 is not detected by the sensors 33 and 34. When the paper sheet P2 is detected by the sensors 33 and 34, the transporting controller 87 turns off the electromagnetic clutch 88, so that the rollers 19 and 20 are stopped. When the paper sheet P2 is not detected by the sensors 33 and 34, the motor M1 has its speed changed so that the transporting speed of the rollers 13 and 14 becomes the rotational velocity needed to transport a sheet at the second read speed V2. The paper sheet P3 then stands by before the merging point 50.

Figure 9C:
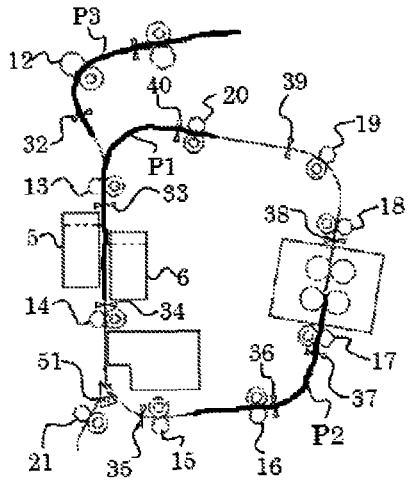

As shown in FIG. 9C, when the sensors 33 and 34 do not detect the paper sheet P2, the transporting controller 87 turns on the electromagnetic clutch 88, and the paper sheet P1 is transported at the erasing speed VE to the second transporting passage. As the front end of the paper sheet P1 enters the roller 13, the paper sheet P1 is transported at the second read speed V2. Because the second read speed V2 is higher than the erasing speed VE, the roller 20 is rotated at a speed higher than the erasing speed VE. The power from the motor M3 to the roller 20 is cut off by the one-way clutch 99, so that the roller rotates in an idling state. The scanners 5 and 6 generate the image data of the paper sheet P1 at the second resolution. The paper sheet P2 is transported at the erasing speed VE to the decoloring unit 7. The paper sheet P3 stands by before the merging point 50. The gate 51 is setting at the position for guiding the paper sheet P1 to the fourth transporting passage.

Figure 9D:
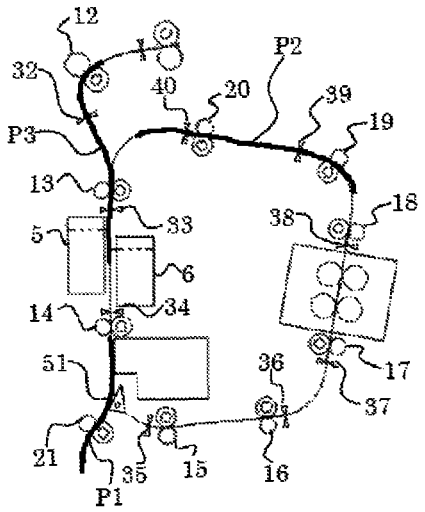

As shown in FIG. 9D, when the rear end of the paper sheet P1 is detected by the paper sensor 34, the transporting controller 87 adjusts the transporting speed of the rollers 13 and 14 so that they rotate at the first read speed V1. As the front end of the paper sheet P1 is detected by the paper sensor 41 or the paper sensor 43, the gate 51 is set at the position for guiding the paper sheet to the third transporting passage, and the paper sheet P3 is transported to the second transporting passage. At this time, the paper sheet P3 is sequentially detected by the sensors 33 and 34. When the front end of the paper sheet P2 is detected by the paper sensor 40, the transporting controller 87 turns off the electromagnetic clutch 88, so that the rollers 19 and 20 are stopped. When the paper sensor 34 does not detect the paper sheet P3, the transporting controller 87 turns on the electromagnetic clutch 88, so that the paper sheet P2 is transported into the second transporting passage. Then, until the reuse process ends for all of the paper sheets, the operation is continued.

Figure 10:
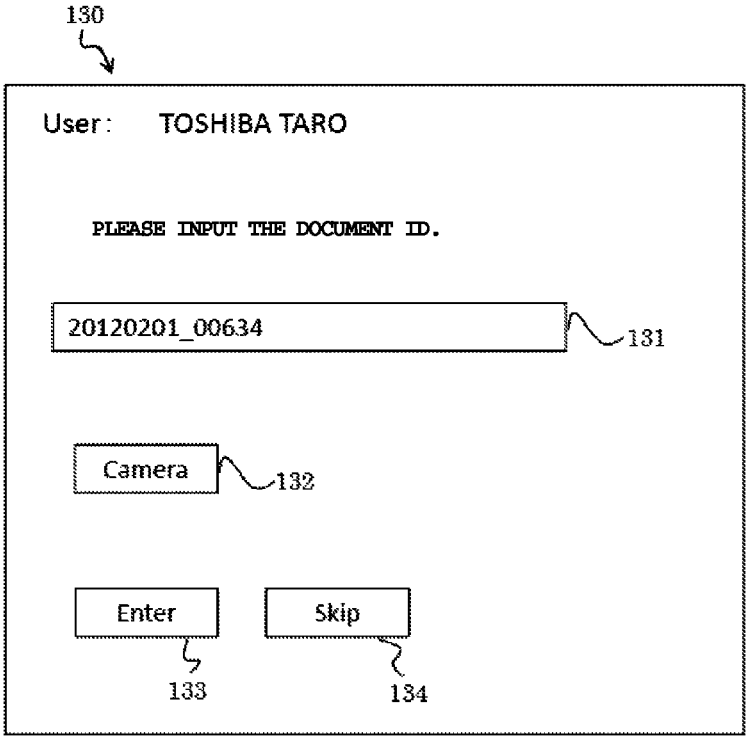
FIG. 10 is a diagram illustrating the configuration of the requesting GUI adopted by the user according to the first embodiment.

FIG. 10 is a diagram illustrating the configuration of the requesting GUI for use by a user. Here, a requesting GUI (graphical user interface) 130 contains an area 131, a camera button 132, an execution (Enter) key 133, and a skip key 134. Here, the area 131 is an area for receiving the request for the input of the document ID. The user can use a software keyboard not shown in the figure to input the document ID printed on the paper sheet.

The camera button 132 is for giving instructions to the camera 93 to acquire the image data. As the user presses the camera button 132, the user can have the document ID, the one-dimensional barcode or the two-dimensional barcode printed on the paper sheet moved to a position near the camera 93. The controller 80 analyzes the image obtained by the camera 93, and it can obtain the document ID and other printing set-up information from the character, the one-dimensional barcode or the two-dimensional barcode.

The Enter key 133 checks the data input to the area 131 or the data acquired by the camera 93. The skip key 134 is used to omit the input of the requesting GUI 130.

Figure 11:
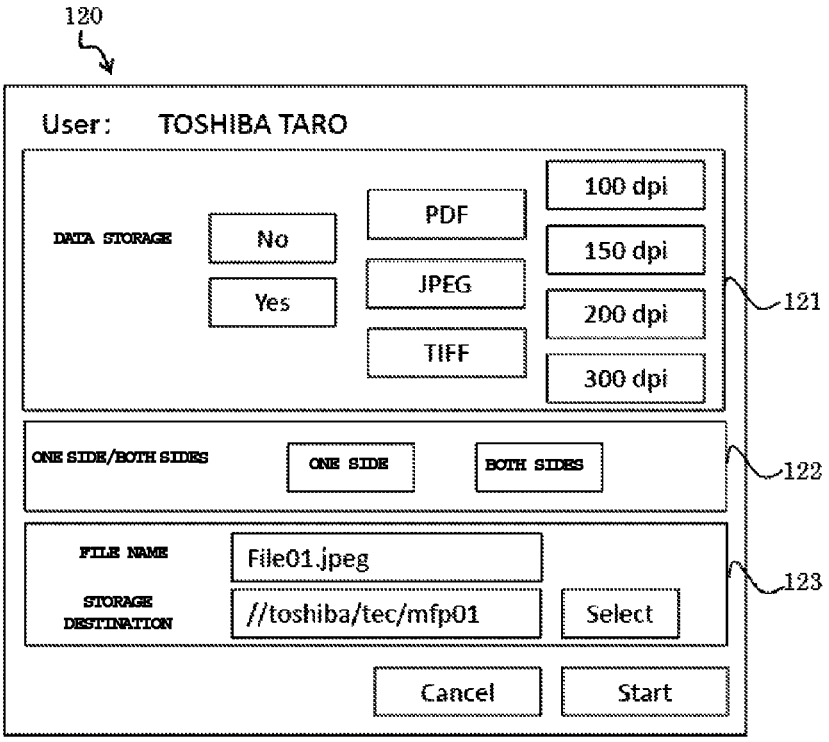
FIG. 11 is a diagram illustrating the configuration of the set-up GUI adopted by the user according to the first embodiment.

FIG. 11 is a diagram illustrating the configuration of the set-up GUI adopted by the user. The set-up GUI 120 is generated by the controller 80, and it is displayed on the touch panel display 84. The plural buttons of the set-up GUI 120 can be selected by the user. The controller 80 receives the selected result from the user and executes the reuse process. The user may use the touch panel display 84, the tag reader 85 or the camera 93 to log in the decoloring system 1. When the user is specified, the user name is displayed on the set-up GUI 120.

The set-up GUI 120 contains region 121, region 122, and region 123. The region 121 is provided for the designation of the storage of the data, and it has a YES button and a NO button indicating yes/no for the instruction of storing the image data. When the user selects the YES button, it indicates that it is possible to select plural resolutions and the storage format of the image data. As the initial value, the set-up GUI 120 for which the YES button is selected is displayed on the touch panel display 84. This initial value executes the decoloring process for the paper sheet so that it works efficiently when the user fails to check on the set-up.

The region 122 is provided for selecting one side or both sides of the paper sheet. Corresponding to the button selected by the user, the heater controller 86 selects either of the reference tables 111 to 112. The region 123 is a region for assigning the address and file name for the storage of the image data generated by the scanners 5 and 6. The user can directly input the address of the HDD 83 and the HDD 97 in the decoloring system 1 and the HDD in the other network. The user can use the select button to assign the address easily.

The start button is a button for initiating the reuse process. The cancel button has the function of resetting the content selected by the user to the initial value.

Figure 12:
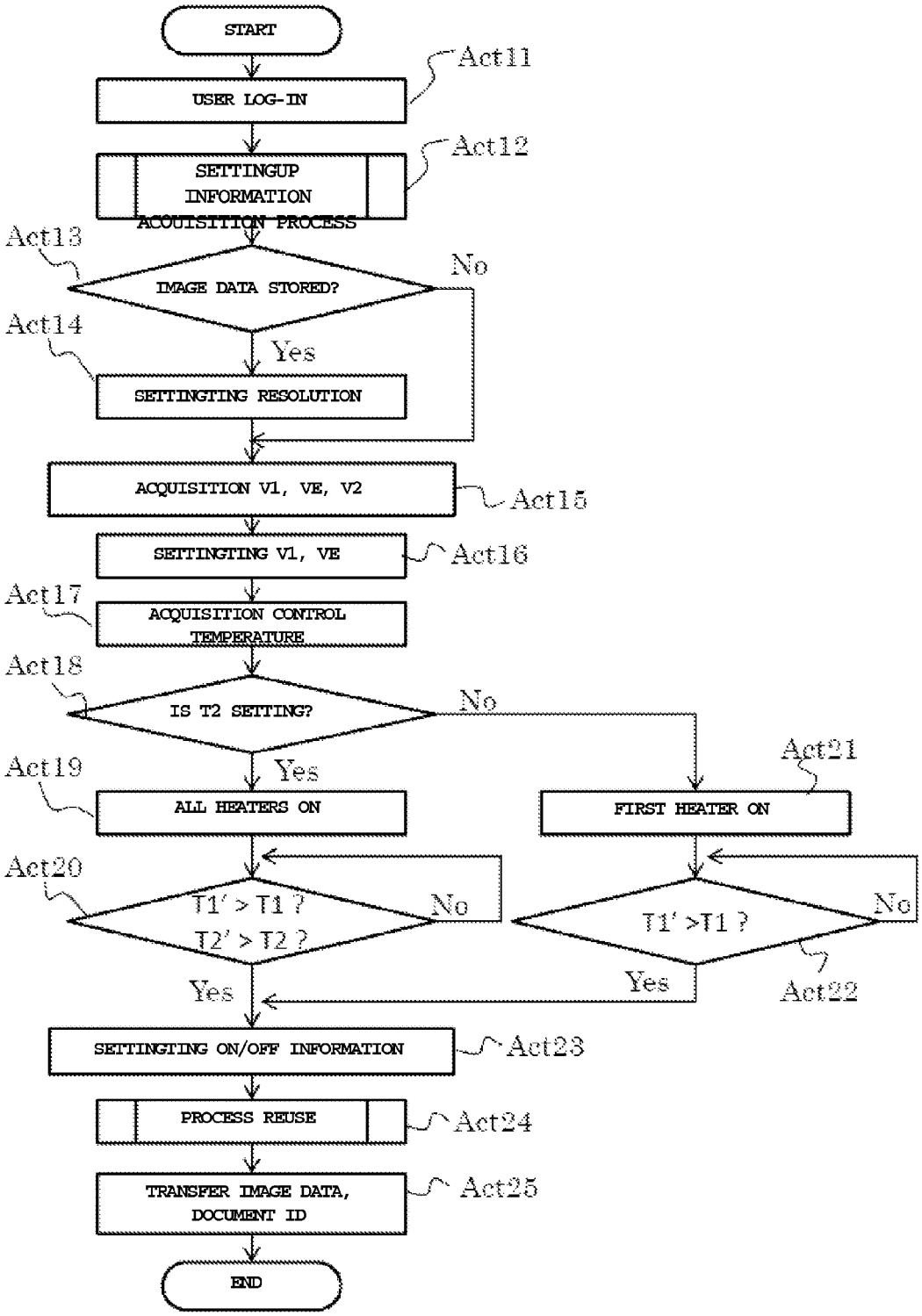
FIG. 12 is a flow chart illustrating the operation of the decoloring system according to the first embodiment.

FIG. 12 is a flow chart illustrating the operation of the decoloring system 1. As the user ID is input from the operation panel 9, the controller 80 determines whether the user ID is correct and gives permission to the user to log in the system (Act 11). The controller 80 starts the set-up information acquisition process routine and acquires the necessary information from the operation panel 9 (Act 12). The set-up information acquisition process routine will be explained in detail later.

The controller 80 checks whether the user instructs that the image data be stored (Act 13). When the storage of the image data is instructed by the user by the operation panel 9, the controller 80 acquires the first resolution setting at the same time, and it sets the first resolution for the scanners 5 and 6 (Act 14). When the user does not instruct that the image data be stored, the controller 80 sets the first resolution as "NON." The controller 80 reads the reference table 110, and it acquires the data of the V1, VE, and V2 on the basis of the setting of the first resolution (Act 15). The transporting controller 87 sets V1 for the motors M1, and M2 and sets VE for the motor M3 (Act 16).

On the basis of the set-up information of the single-sided/double-sided that has been established, the temperature reference table 111 or the temperature reference table 112 is selected by the controller 80. On the basis of the first resolution setting, the controller 80 acquires the control temperature data from the selected temperature reference table (Act 17). The controller 80 then checks whether the control temperature T2 is properly set (Act 18). When the control temperature T2 is set, the heater controller 86 starts turning on the first, second and third heaters (Act 19).

The heater controller 86 keeps the first heater ON until the temperature T1' that is detected by the temperature sensor 67 exceeds the control temperature T1. The heater controller 86 keeps the second and third heaters ON until the temperature T2' that is detected by the temperature sensor 68 rises above the control temperature T2.

In Act 18, when the control temperature T2 is not set, the heater controller 86 starts turning on the first heater (Act 21). The first heater is kept ON until the temperature T1' that is detected by the temperature sensor 67 exceeds the control temperature T1 (Act 22). When T1' and T2' become over a prescribed temperature, the controller 80 reads the ON/OFF information of the first to third heaters from the temperature reference table. The heater controller 86 determines which heater should be turned on during the decoloring process on the basis of the ON/OFF information (Act 23). When all of the information has been set, and the warming-up of the decoloring system 1 ends, the controller 80 carries out the reuse process (Act 24). After the end of all of the reuse processes, the image data generated by the scanners 5 and 6 are stored at the assigned address in the network (Act 25). The flag indicating the end of the document ID and the reuse process is sent to the server 96.

Figure 13:
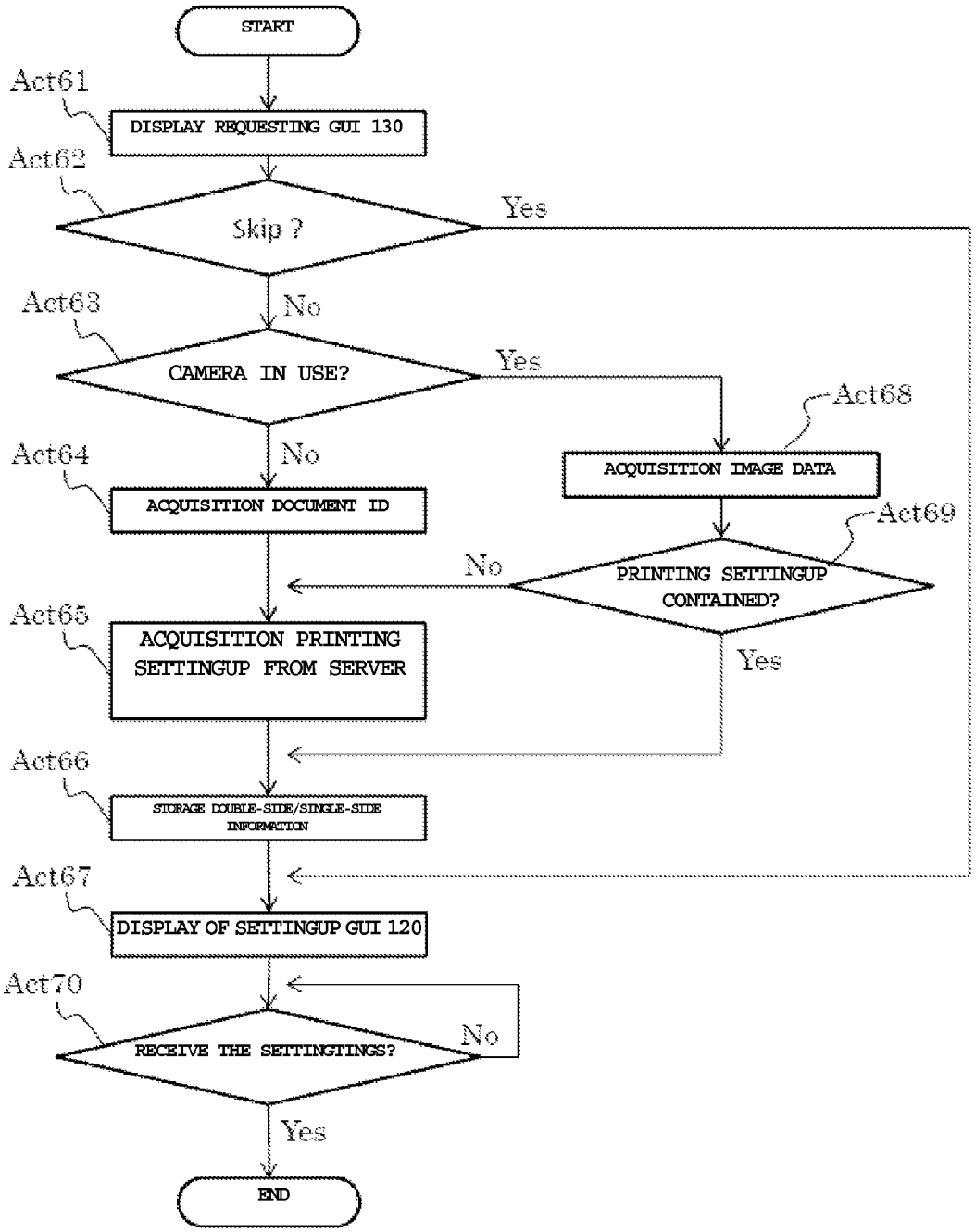
FIG. 13 is a flow chart illustrating the set-up information acquisition process according to the first embodiment.

FIG. 13 is a flow chart illustrating the set-up information acquisition process. In Act 11, when the user is permitted to log in to the decoloring system 1, the controller 80 displays the requesting GUI 130 on the touch panel display 84 (Act 61). The controller 80 then checks whether the skip button 134 is pressed by the user (Act 62). If the skip button 134 is pressed, the set-up GUI 120 is displayed on the touch panel display 84 (Act 67).

If the skip button 134 is not pressed by the user, the controller 80 checks whether the camera button 132 is pressed (Act 63). If the camera button is not pressed, the controller 80 acquires the document ID that has been input into the area 131 (Act 64). Then, the controller 80 sends the document ID to the server 95 and acquires the printing set-up information related to the document ID (Act 65); it also stores the single-sided/double-sided information of the printing set-up information (Act 66). When the user presses the Enter button 132, the controller 80 displays the set-up GUI 120 on the touch panel display 84 (Act 67).

In Act 63, as the user presses the camera button 132, the camera 93 generates the image data. The generated image data are sent to the controller 80. The controller 80 then extracts the document ID from the image data (Act 68). The controller 80 then checks whether the printing set-up information is contained (Act 69). When the printing set-up information is contained in the image data, the controller 80 goes to Act 66. When the printing set-up information is not contained in the image data, the controller 80 sends the document ID to the server 96, and it goes to Act 65.

In Act 67, when the set-up GUI 120 is displayed on the touch panel display 84, the user may carry out the setting up of the data storage, the setting up of the double-side/single-side, and the selection of the file name and the storage address. As the user presses the start button, the controller receives the setting up data about the data storage, the setting up of the double-side/single-side, the file name, and the storage destination (Act 70). In Act 65, if the double-sided/single-sided set up received by the server 95 is different from the selection by the user in Act 70, the set-up of double-side/single-side provided by the user is given the priority.

Figure 14:
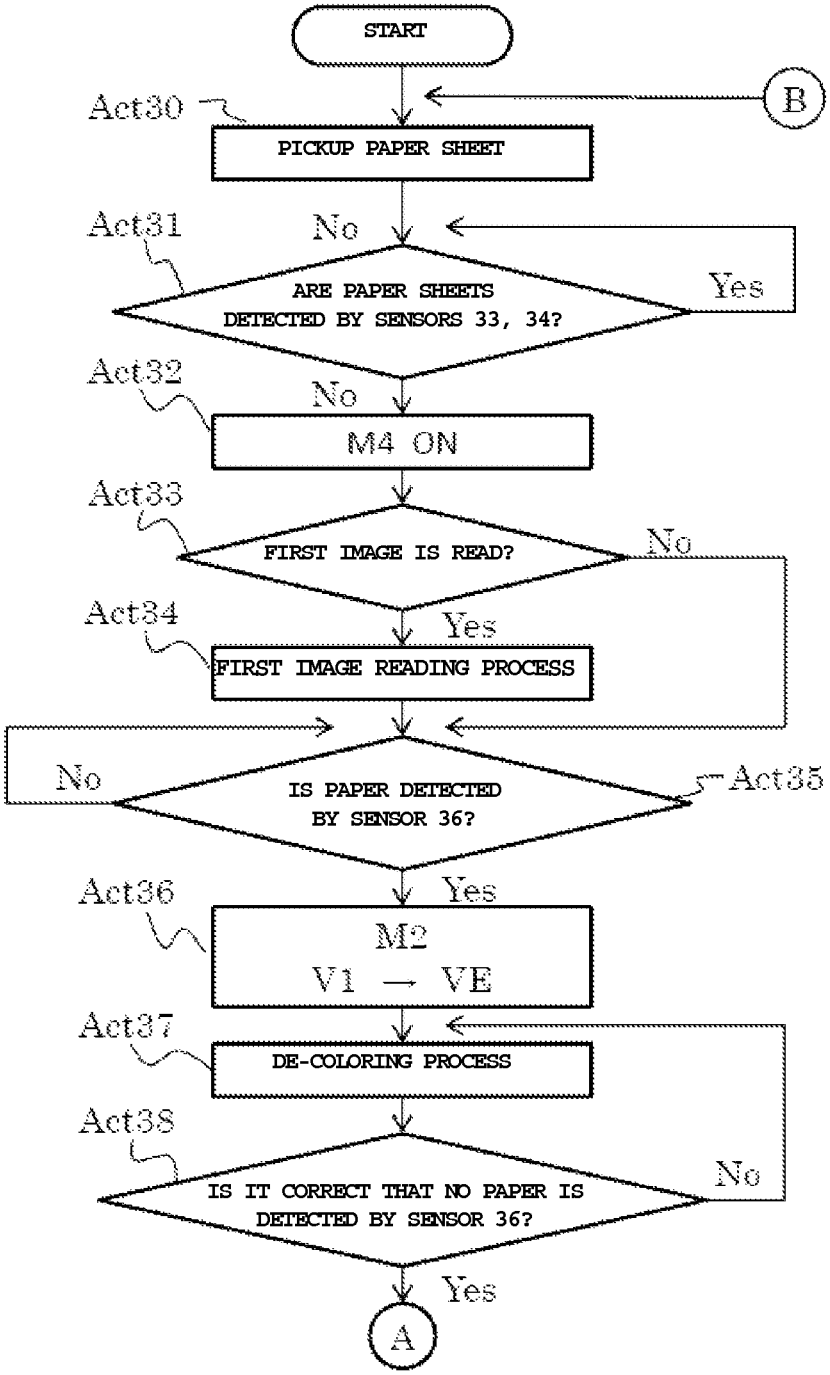
FIG. 14 is a flow chart illustrating the reuse process in the first embodiment.
Figure 15:
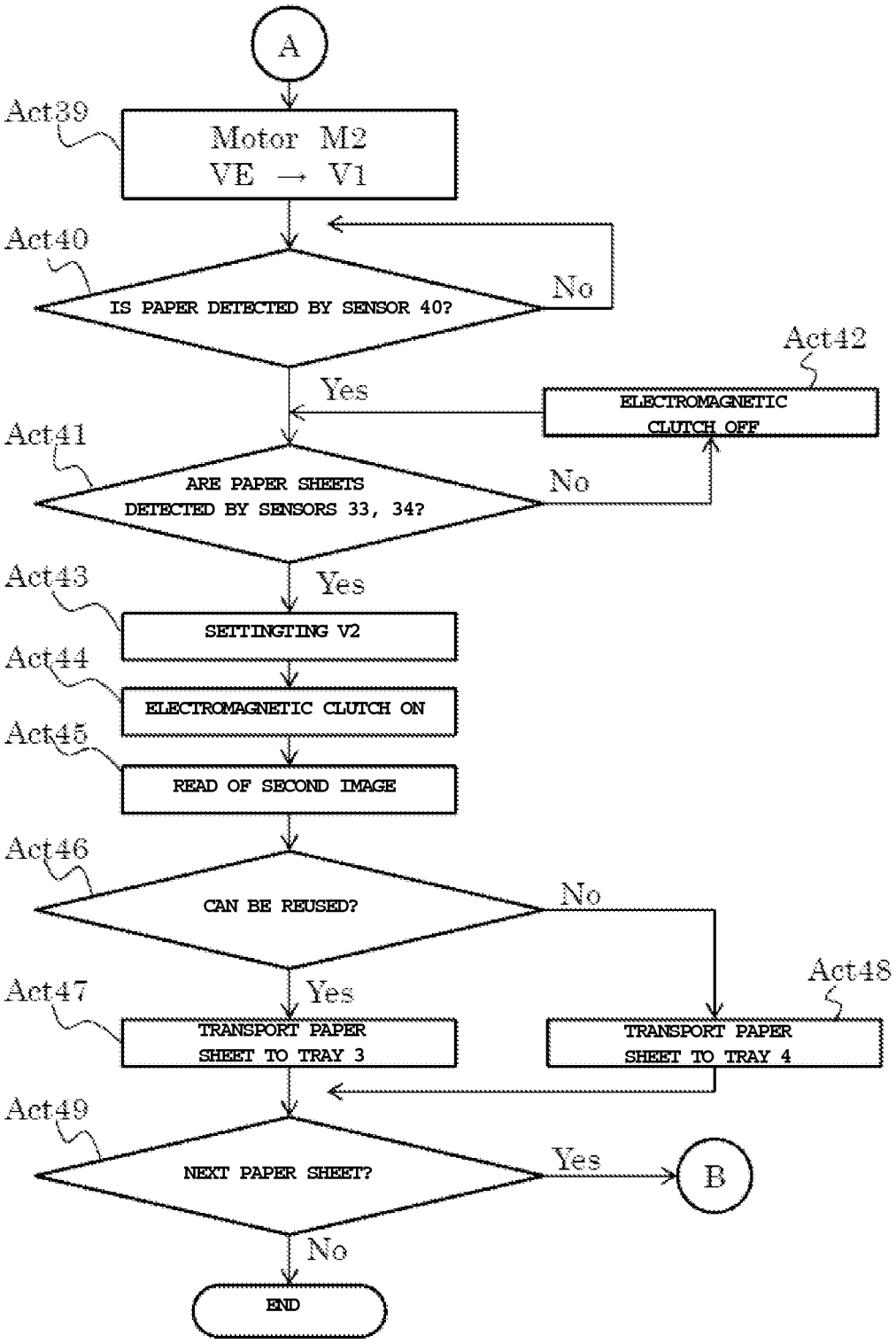
FIG. 15 is a flow chart illustrating the reuse process in the first embodiment.

FIGS. 14 and 15 are flow charts illustrating the reuse process. The reuse process is carried out one paper sheet at a time. In practice, however, controller 80 may carryout the same or similar processes in parallel for the various paper sheets under the process.

After the initiation of Act 24, the rollers 10, 11, and 12 pickup the paper sheet in the paper feeding tray 2 and transport it into the first transporting passage (Act 30). The transporting controller 87 checks whether the sensors 33 and 34 in the second transporting passage detect the paper sheet (Act 31). When the sensors 33 and 34 do not detect the paper sheet, the transporting controller 87 has the motor M4 turned on and has the paper sheet in the first transporting passage transported to the second transporting passage (Act 32). The controller 80 checks whether the storage of data is assigned by the set-up GUI 120 (Act 33). When the user assigns the storage of the image data, the first image read process is executed (Act 34). The first image read process will be explained in detail later.

The transporting controller 87 controls the motor M2 so that it operates to move the sheet at the first read speed V1 until the front end of the paper sheet is detected by the sensor 36 (Act 35). When the sensor 36 detects the front end of the paper sheet, the transporting controller 87 controls the motor M2 so that the paper sheet transporting speed is changed to the erasing speed VE (Act 36). As the motor M2 changes the paper sheet transporting speed to the erasing speed VE, the paper sheet is transported to the decoloring unit 7, and the decoloring process is carried out (Act 37). While the sensor 36 detects the paper sheet, the motor M2 has the paper sheet transporting speed kept at VE (Act 38).

When the sensor 36 no longer detects the paper sheet, the transporting controller 87 changes the motor M2 so that the speed of a sheet becomes the first read speed V1 (Act 39). The transporting controller 87 waits for the detection of the front end of the paper sheet that the paper sensor 40 has passed the decoloring unit 7 (Act 40). When the paper sensor 40 detects the front end of the paper sheet, the transporting controller 87 checks whether the sensors 33 and 34 detect another paper sheet (Act 41). When the sensors 33 and 34 detect another paper sheet, the transporting controller 87 turns off the electromagnetic clutch, so that the paper sheet in the third transporting passage is stopped (Act 42).

When the sensors 33 and 34 do not detect another paper sheet, the transporting controller 87 controls the motor M2 to adjust it to the second read speed V2 (Act 43). The electromagnetic clutch is turned on, and the paper sheet in the third transporting passage is transported to the second transporting passage. The scanners 5 and 6 generate the image data from both sides of the paper sheet at the second resolution (Act 45). The image processing section 91 analyzes the image data and determines whether the paper sheet can be reused (Act 46).

When the paper sheet can be reused, the paper sheet is transported to the paper exhausting tray 3 (Act 47). When the paper sheet cannot be reused, the paper sheet is transported to the paper exhausting tray 4 (Act 48). When there is paper sheet in the paper feeding tray 3, the controller 80 returns to Act 30. When there is no paper sheet in the paper feeding tray 3, the controller 80 sends the image generated by the scanners 5 and 6 to the assigned address on the network, and the entire process comes to an end.

Figure 16:
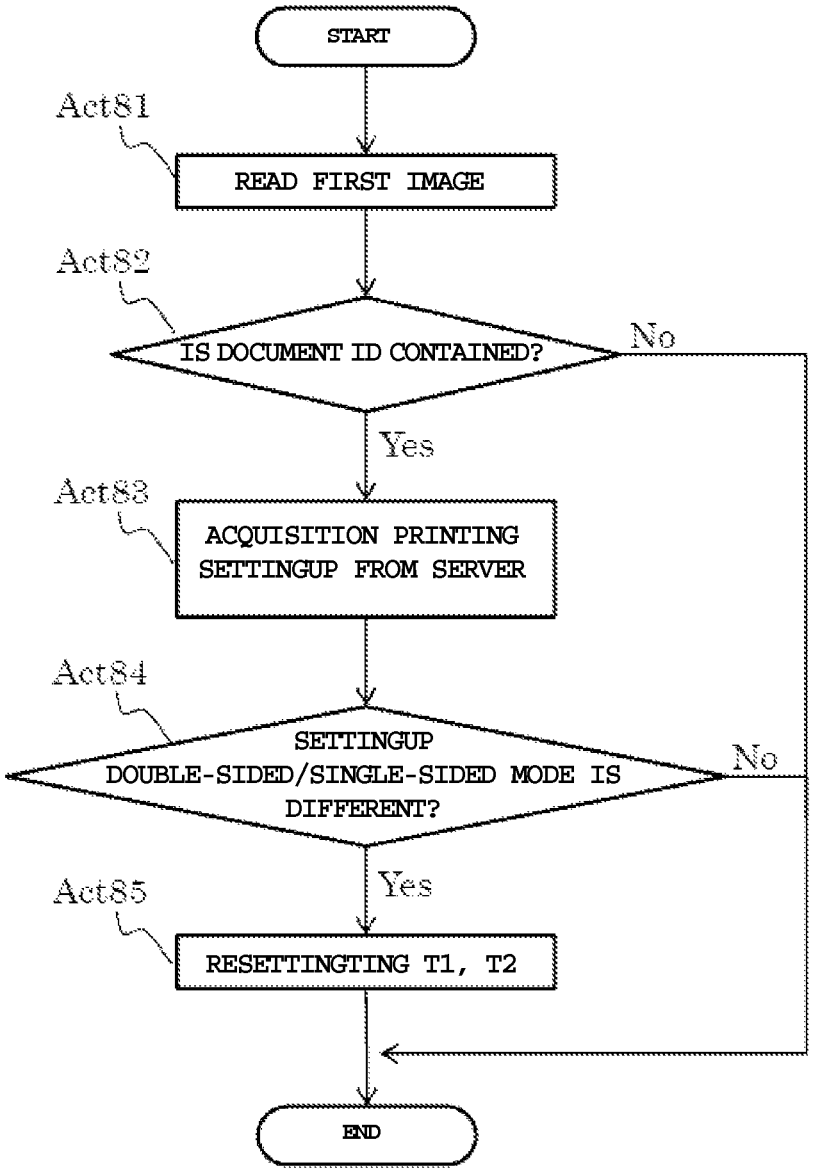
FIG. 16 is a flow chart of the first image read process according to the first embodiment.

FIG. 16 is a flow chart illustrating the first image read process. As the first image read process is started, the images on both sides of the paper sheet are read by the scanners 5 and 6 to acquire the image data (Act 81). The image processing section 91 analyzes the information about the prescribed position of the image data and checks whether the document ID is contained (Act 82). If the document ID is not contained in the image data, this flow comes to an end.

When the document ID is contained in the image data, the controller 80 sends the document ID to the server 95, and it acquires the printing set-up data related to the document ID (Act 83). The controller 80 then checks whether the double-sided/single-sided information set in Act 17 is different from the double-sided/single-sided information acquired in Act 83 (Act 84). If the two information pieces are the same, this flow comes to an end. When the information pieces are different, the data acquired in Act 83 is given priority, and the controller 80 reads the temperature reference table 111 or 112. The heater controller 86 reads the values of the control temperatures T1 and T2 from the resolution that has been set and changes the values of T1 and T2 (Act 85).

The decoloring system 1 in the embodiment can be controlled to have the optimum paper sheet transporting speed and the temperature of the heating rollers on the basis of the presence/absence for storing of the image data, the resolution, and the double-sided/single-sided information as setting by the user. As the paper sheet is not excessively heated by the decoloring unit, it is possible to cut the power consumption. Also, it is possible to alleviate the adverse influence of the heat of the paper sheet on the scanners.

According to the first embodiment, the controller 80, the heater controller 86, and the transporting controller 87 in the decoloring system 1 work together to control the decoloring system 1. The various functions of these controllers can also be carried out under the control of a single controller. Also, one may adopt a configuration wherein the various functions are executed by the plural controllers including the server 95 and other controllers in the network and the controllers in the decoloring system 1.

The various functions may also be carried out by ASIC or another hardware circuit and they may also be carried out by the program executed by the CPU in the controller.

While certain embodiments have been described, these embodiments have been presented by way of example only, and they are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decoloring system comprising:
- a first scanner that reads an image on a paper sheet and generates image data;
- a first roller that applies heat to the paper sheet to decolor the image on the paper sheet;
- a heater that heats the roller;
- a first transporting mechanism that transports the paper sheet to the scanner;
- a second transporting mechanism that transports the paper sheet to the heater via the first transporting mechanism;
- a camera that reads a marking on the paper sheet; and
- a controller that accesses a memory that records the marking and a printing set-up related to the marking, and on the basis of the marking, acquires the printing set-up and determines an operating condition of the heater and a transporting speed of the paper sheet by the first transporting mechanism and the second transporting mechanism on the basis of a marking on the sheet.

2. The decoloring system according to claim 1, wherein
- the printing set-up includes information indicating whether a mode is a single-sided mode with the image formed on one side of the paper sheet or a double-sided mode with the images formed on both sides of the paper sheet;
- when the single-sided mode is received, the controller controls the heater so that a surface temperature of the roller becomes a first temperature; and
- when the double-sided mode is received, the controller controls the heater so that the surface temperature of the roller becomes a second temperature higher than the first temperature.

3. The decoloring system according to claim 2, further comprising:
- an operation panel that receives from the user input of the read set-up of the image containing the read mode of the single side or double side of the paper sheet for the first scanner, wherein
- the controller acquires the specific code read by the first scanner or the single-sided/ double-sided read mode related to the printing set-up; and
- when the value of the single-sided/double-sided mode is different at the operation panel and the first scanner, the controller takes the value of the first scanner as the priority.

4. The decoloring system according to claim 1, further comprising:
- an operation panel that receives input of a read set-up of the image adopting the first scanner by the user.

5. The decoloring system according to claim 4, wherein a read condition of the image contains resolution of the image data generated by the first scanner; and when a first resolution is received from the operation panel, the controller sets the transporting speed of the paper sheet in the first and second transporting mechanisms lower than that when a second resolution higher than the first resolution is received.

6. The decoloring system according to claim 5, wherein when the first resolution is received, the controller controls the heater so that the surface temperature of the roller becomes a third temperature, and when the second resolution is received, the controller controls the heater so that the surface temperature of the roller becomes a fourth temperature lowers than the third temperature.

7. The decoloring system according to claim 4, wherein the read condition of the image contains information indicating whether the image data are generated by the first scanner; and when an instruction for generation of the image data is input to the operation panel, the controller sets the transporting speed of the paper sheet provided by the first and second transporting mechanisms to be lower than that in the case when an instruction for generation of the image data is not input.

8. The decoloring system according to claim 7, wherein when the instruction for generation of the image data is input, the controller controls the heater so that the surface temperature of the roller becomes a fifth temperature; and when the fifth resolution is received, the controller controls the heater so that the surface temperature of the roller becomes a sixth temperature that is lower than the fifth temperature.

9. A decoloring system comprising:

a first scanner that reads an image on a paper sheet and generates image data;

a first roller that applies heat to the paper sheet to decolor the image on the paper sheet;

a heater that heats the roller;

a first transporting mechanism that transports the paper sheet to the scanner;

a second transporting mechanism that transports the paper sheet to the heater via the first transporting mechanism;

an operation panel that receives input of a specific code; and a controller receives the specific code input by a user via the operation panel relating to the marking, accesses the memory that records the specific code and the printing set-up related to the specific code, acquires the printing set-up on the basis of the marking related to the specific code acquired by the camera, and determines an operating condition of the heater and a transporting speed of the paper sheet by the first transporting mechanism and the second transporting mechanism on the basis of a marking on the sheet.

10. A control method of the decoloring system having a scanner for reading the image on the paper sheet and a decoloring unit for decoloring the image, the method comprising:

reading, with a camera, a marking printed on the paper accessing a memory that records the marking and a printing set-up related to the marking, and on the basis of the marking, acquiring the printing set-up from the memory;

on the basis of the printing set-up, setting the read transporting speed for transporting the paper sheet to the scanner, the decoloring transporting speed for transporting the paper sheet, which has been transported to the scanner, to the decoloring unit, and the temperature at which the decoloring unit heats the paper sheet;

according to a received read condition, generating the image data from the image on the paper sheet; and decoloring the image on the paper sheet at the set temperature.

11. The control method according to claim 10, further comprising:

determining whether the printing set-up is the single-sided mode in which the image is formed on one side of the paper sheet or the double-sided mode in which the images are formed on both sides of the paper sheet, wherein if the determination result is the single-sided mode, the decoloring unit is controlled to heat the paper sheet at the first temperature;

if the determination result is the double-sided mode, the decoloring unit is controlled to heat the paper sheet at the second temperature higher than the second temperature.

12. The control method according to claim 10, further comprising:

determining whether the printing set-up is the single-sided mode in which the image is formed on one side of the paper sheet or the double-sided mode in which the images are formed on both sides of the paper sheet; wherein when the determination result is the single-sided mode, the decoloring unit is controlled so that the paper sheet is heated at the first temperature; and when the determination result is the double-sided mode, the decoloring unit is controlled so that the paper sheet is heated at the second temperature higher than the first temperature.

13. The control method according to claim 10, further comprising:

determining whether the printing set-up is the single-sided mode in which the image is formed on one side of the paper sheet or the double-sided mode in which the images are formed on both sides of the paper sheet; wherein if the determination result is the single-sided mode, the decoloring unit is controlled so that the paper sheet is heated at the first temperature; and if the determination result is the double-sided mode, the decoloring unit is controlled so that the paper sheet is heated at the second temperature higher than the first temperature.

14. The control method according to claim 10, further comprising:

receiving the value of the double-sided/single-sided mode for the scanner from the operation panel;

receiving the value of the double-sided/single-sided mode contained in the printing set-up; wherein when the value of the double-sided/single-sided mode received from the operation panel is different from that contained in the printing set-up, the double-sided/single-sided mode's value contained in the printing set-up is selected; and the read transporting speed, the decoloring transporting speed and the temperature are changed.

15. The control method according to claim 10, further comprising:

generating the image data of the image on the surface of the paper sheet after decoloring of the image; and determining whether the paper sheet can be reused.

16. The control method according to claim 10, further comprising:

sending the generated image data to the external device.

* * * * *